US006138872A

United States Patent [19]

Brennan et al.

[11] Patent Number: 6,138,872

[45] Date of Patent: Oct. 31, 2000

[54] APPARATUS FOR DISPENSING OF TWO COMPONENT ADHESIVE FROM STATIC MIXER

[75] Inventors: Thomas J. Brennan, Farmington Hills; Timothy A. Ferguson, Fowlerville, both of Mich.

[73] Assignee: Graco Inc, Minneapolis, Minn.

[21] Appl. No.: 09/149,230

[22] Filed: Sep. 8, 1998

Related U.S. Application Data

[60] Provisional application No. 60/058,923, Sep. 9, 1997, abandoned.

[51] Int. Cl.[7] ..... B67D 5/56

[52] U.S. Cl. ..... 222/145.6; 222/567; 222/568; 222/569; 239/590

[58] Field of Search ..... 222/145.6, 137, 222/575, 567–570; 239/590, 589, 601–602, 390, 391, 396

[56] References Cited

U.S. PATENT DOCUMENTS

| | | | |
|---|---|---|---|
| 2,297,239 | 9/1942 | Neugebauer et al. | 239/589 X |
| 4,830,280 | 5/1989 | Yankoff | 239/590 X |
| 4,995,540 | 2/1991 | Colin et al. | 222/145.6 X |
| 5,092,492 | 3/1992 | Centea | 222/145.6 X |
| 5,263,614 | 11/1993 | Jacobsen et al. | 222/145.6 X |

*Primary Examiner*—Henry J. Recla
*Assistant Examiner*—Kathleen J. Prunner
*Attorney, Agent, or Firm*—Douglas B. Farrow

[57] ABSTRACT

An apparatus for dispensing of two component adhesive utilizes a conventional static mixer which is supplied with an insert providing a reduced outlet diameter source to allow streaming of the adhesive from the mixer.

2 Claims, 1 Drawing Sheet

APPARATUS FOR DISPENSING OF TWO COMPONENT ADHESIVE FROM STATIC MIXER

RELATED APPLICATIONS

This application is a continuation-in-part of U.S. application Ser. No. 60/058,923, filed Sep. 9, 1997 now abondoned.

BACKGROUND OF THE INVENTION

While static mixers for dispensing (robotically or otherwise) two component adhesives are generally well known and include those of the type manufactured by TAH, such tips have typically provided an extruded stream which requires that the dispense tip be located fairly close (on the order of 1.2 times the bead diameter) to the part on which the adhesive is being applied. Such a small standoff distance requires careful programming of the robot path in order that proper standoff distance be maintained.

SUMMARY OF THE INVENTION

It is therefore an object of this invention to provide a two component static mixer adhesive dispensing device which is easily and inexpensively manufactured and which is capable of being utilized at substantially increased standoff distances compared to the current prior art devices.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
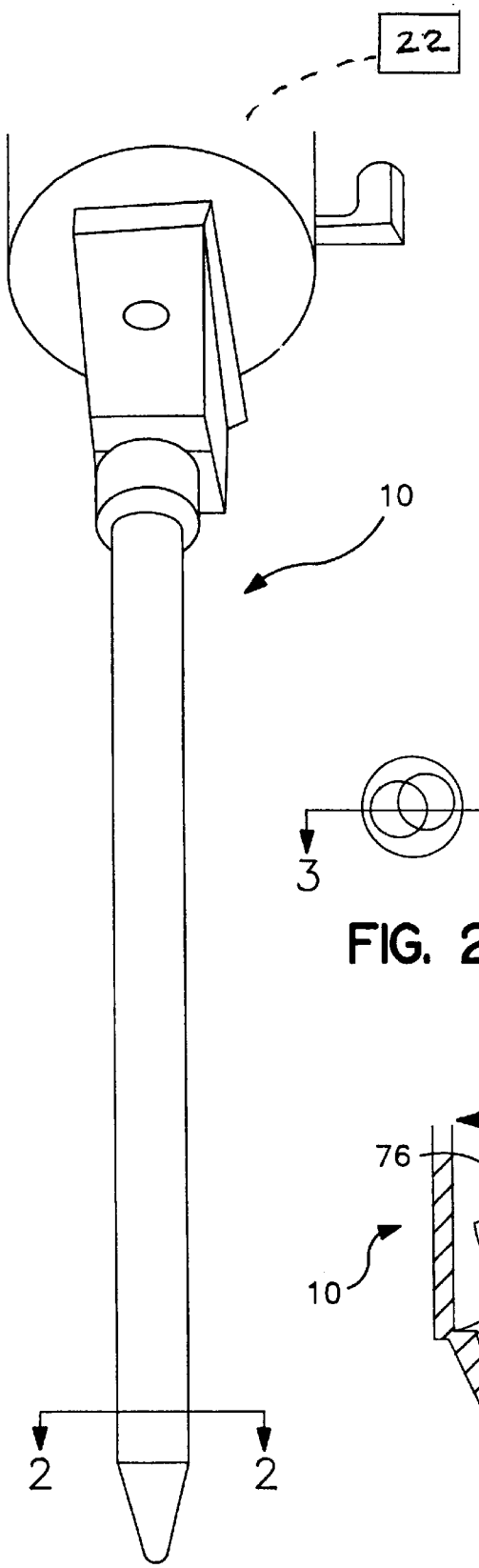
FIG. 1 is a perspective view of the instant invention.
Figure 2:
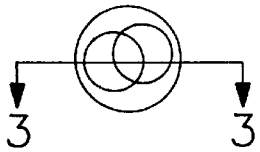
FIG. 2 is a sectional view of the instant invention taken along line 2—2 of FIG. 1.
Figure 3A:
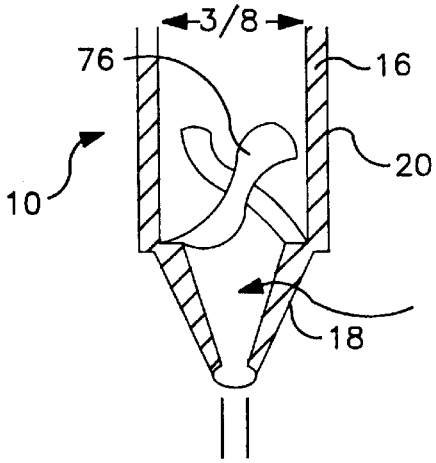
FIG. 3 is a sectional view of the instant invention taken along line 3—3 of FIG. 2.
Figure 4:
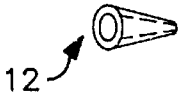
FIG. 4 is a perspective view of the insert of the instant invention.
Figure 3B:
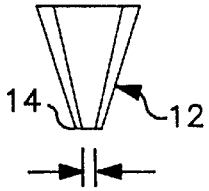

The instant invention is generally designated 10 is connected to a source 22 of said adhesives at elevated pressure and is comprised of a bullet shaped insert 12 which has a through discharge hole 14 of less than 0.090 inches. This insert is placed inside the discharge end 18 of the standard static mixer 16 which usually has a discharge orifice of 0.090 inches or greater.

For the same desired flow rate, a higher discharge pressure will be required to pass through the smaller discharge orifice. Such a higher pressure thereby creates a higher adhesive exit velocity which in turn creates a stream which can be directed at the substrate at a greater standoff distance. The higher pressure will at least in part be provided by the more restrictive orifice but increased system pressure may be required as well.

In the preferred embodiment, the static mixer shroud 20 contains twenty four mix elements 26 and has an inside diameter of ⅜ inch, and a discharge orifice diameter of 0.120 inches. The bullet shaped insert 12 is provided with a discharge diameter 14 of 0.040 inches and a standoff distance of one to two inches may be maintained.

It is contemplated that various changes and modifications may be made to the dispenser without departing from the spirit and scope of the invention as defined by the following claims.

What is claimed is:

1. A mixer for streamingly dispensing plural component adhesives at elevated pressures, said mixer comprising:

a shroud connected to a source of said adhesives at elevated pressures, said shroud having a tapered discharge end;

a plurality of mix elements contained within said shroud;

a dispensing insert contained in said tapered shroud discharge end, said insert having a reduced diameter relative to said shroud discharge end said reduced diameter being sized to enable streaming of said adhesive at said elevated pressures.

2. The mixer of claim 1 wherein said insert has a discharge diameter of approximately 0.040 inches.

* * * * *